US011296424B2

(12) United States Patent
West et al.

(10) Patent No.: US 11,296,424 B2
(45) Date of Patent: Apr. 5, 2022

(54) BUMP MOUNTED RADIATING ELEMENT ARCHITECTURE

(71) Applicant: Rockwell Collins, Inc., Cedar Rapids, IA (US)

(72) Inventors: James B. West, Cedar Rapids, IA (US); Jiwon L. Moran, Marion, IA (US); Christopher G. Olson, Phoenix, AZ (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 26 days.

(21) Appl. No.: 16/748,291

(22) Filed: Jan. 21, 2020

(65) Prior Publication Data

US 2021/0226342 A1 Jul. 22, 2021

(51) Int. Cl.

| | |
|---|---|
| ***H01Q 21/00*** | (2006.01) |
| ***H01Q 15/24*** | (2006.01) |
| ***H01Q 21/06*** | (2006.01) |
| ***H01Q 1/48*** | (2006.01) |

(52) U.S. Cl.

CPC ..... *H01Q 21/0093* (2013.01); *H01Q 1/48* (2013.01); *H01Q 15/24* (2013.01); *H01Q 21/0025* (2013.01); *H01Q 21/061* (2013.01)

(58) Field of Classification Search

CPC ..... H01Q 21/0006; H01Q 21/0025; H01Q 21/0087; H01Q 21/0093; H01Q 21/06; H01Q 21/061; H01Q 21/065; H01Q 1/2283; H01Q 1/52; H01Q 1/521; H01Q 1/523; H01Q 3/2658; H01L 23/14; H01L 23/488

See application file for complete search history.

(56) References Cited

U.S. PATENT DOCUMENTS

| | | | | |
|---|---|---|---|---|
| 6,366,259 | B1 | 4/2002 | Pruett et al. | |
| 7,411,472 | B1 | 8/2008 | West et al. | |
| 9,019,166 | B2 | 4/2015 | Puzella et al. | |
| 9,035,848 | B2 | 5/2015 | Infante et al. | |
| 9,985,346 | B2 * | 5/2018 | Baks | H01L 23/66 |
| 10,777,518 | B1 * | 9/2020 | Wang | H01L 23/3128 |
| 2009/0322643 | A1 | 12/2009 | Choudhury | |

(Continued)

FOREIGN PATENT DOCUMENTS

| | | | |
|---|---|---|---|
| AU | 2001282893 | A1 | 2/2002 |
| NO | 20030228 | L | 3/2003 |
| WO | 2019129298 | A1 | 7/2019 |

OTHER PUBLICATIONS

Extended Search Report for European Application No. 21152707.2 dated Jun. 16, 2021, 11 pages.

*Primary Examiner* — Jason Crawford

(74) *Attorney, Agent, or Firm* — Suiter Swantz pc llo

(57) ABSTRACT

An antenna and manufacturing process for antennas produce radiating elements of desired size for certain frequency bands by bump mounting radiating elements to the printed circuit board substrate. Driving circuitry is stacked to save space. Also, the radiating elements are made using a different dielectric constant material as compared to the substrate. Tiling radiating elements or sub-arrays or radiating elements with bump mounting allows for spatial separation that eliminates surface waves. Bump mounted radiating elements also allow for multiple sizes of radiating elements in which smaller size provides lower directivity to cover broader beam scan performance.

11 Claims, 6 Drawing Sheets

(56) References Cited

U.S. PATENT DOCUMENTS

| | | | | |
|---|---|---|---|---|
| 2012/0263244 | A1* | 10/2012 | Kyles | H01Q 19/18 375/259 |
| 2014/0210668 | A1* | 7/2014 | Wang | H04B 7/0665 342/372 |
| 2014/0266919 | A1* | 9/2014 | Chen | H01L 25/16 343/700 MS |
| 2015/0340765 | A1* | 11/2015 | Dang | H01Q 21/0075 343/893 |
| 2016/0359230 | A1* | 12/2016 | Wang | H01Q 21/0025 |
| 2017/0033462 | A1* | 2/2017 | Clemente | H01Q 1/38 |
| 2017/0229784 | A1* | 8/2017 | Kitamura | H01Q 21/065 |
| 2017/0236776 | A1* | 8/2017 | Huynh | H01Q 9/285 257/428 |
| 2018/0175476 | A1* | 6/2018 | Teshiba | H01L 23/552 |
| 2019/0013580 | A1 | 1/2019 | Vigano et al. | |
| 2019/0089048 | A1* | 3/2019 | Kanar | H01Q 19/30 |
| 2019/0274055 | A1 | 9/2019 | Brechko et al. | |
| 2020/0021010 | A1* | 1/2020 | Ou | H01Q 1/243 |
| 2020/0091581 | A1* | 3/2020 | Ou | H05K 1/141 |
| 2020/0303806 | A1* | 9/2020 | Wu | H01L 23/49816 |
| 2020/0313279 | A1* | 10/2020 | Kim | H01Q 21/28 |
| 2021/0013585 | A1* | 1/2021 | Ho | H01Q 1/2283 |
| 2021/0050651 | A1* | 2/2021 | Jung | H01Q 19/30 |

* cited by examiner

BUMP MOUNTED RADIATING ELEMENT ARCHITECTURE

BACKGROUND

Manufacturing monolithic printed circuit board advanced printed aperture technology is generally useful in X Band to Ku Band in terms of high yield printed circuit boards, radio-frequency integrated circuit (RFIC) assembly, and environmentally robust multi-layer printed circuit board active electronically scanned array (AESA) architectures. Extensions to C band and Ka band is possible. Other high-performance printed radiating element arrays, such as complex microstrip patches and top-hat loaded stacked patches are difficult to manufacture for frequencies in the C band or below.

At high frequencies above Ka band, space for required components and circuitry is not available within the ½λ by ½λ radiating element grid for planar aperture technology without the use of advanced packaging techniques such as die stacking, through silicon vias, and through mold vias. Embedded radiating elements on high dielectric constant materials (Si, SOI, GaAs or GaN, InP, etc.) exhibit high Q and narrow instantaneous bandwidth. A high dielectric constant exacerbates parasitic surface wave generation which causes poor AESA scan performance, including devastating scan blindness. Printed radiating elements benefit from as low a dielectric constant and lattice density as requirements allow (λ/2 element spacing at $f_{high}$).

Other broadband printed radiating elements, such as complex microstrip patches and top-hat loaded stacked patches, are difficult to manufacture for higher millimeter wave frequencies due to their high sensitivity to mechanical and material property tolerances.

AESA beam width, and hence directivity, is a function of aperture size in terms of wavelength: one wavelength (λ) equals twelve inches at one GHz. Printed radiating element thickness is strongly correlated to operating frequency; the lower the frequency, the larger and thicker the printed circuit board material required. The maximum RF printed circuit board thickness available in the industry today is approximately 300 mils, placing a lower frequency limit of approximately six GHz for a standard patch antenna element. The required thickness for a printed aperture radiator at two GHz is approximately 800 mils.

With contemporary manufacturing processes, printed circuit board panel size is eighteen inches by twenty-four inches which is only 1.5λ by 2.0λ at one GHz; equating to a 14.0 dBi directivity and 25° 3-dB beam width, which is a very modest directionality. Adequate directionality requires subarray tilling utilizing multiple printed circuit boards which increases the assembly complexity to meet requirements for an uninterrupted periodic array lattice across multiple subarray panels for low side lobe level operation.

Parasitic surface waves cause scan anomalies and scan blindness in AESA apertures. A grounded dielectric slab parasitic surface wave can be excited in a printed AESA aperture as a function of dielectric constant and printed circuit board thickness; such parasitic surface wave is a function of wavelength. High directivity/narrow beam width arrays are volumetrically large, resulting in high weight due to printed circuit board material density. Furthermore, there are manufacturing constraints for low-risk printed antenna radiating elements/AESA radiating aperture subarrays and arrays. These constraints include available material parameters and tolerances, dielectric material homogeneity, dielectric constant, loss tangent, trace conductivity, printed circuit board thickness, available element count, copper etching tolerances, pressed thickness tolerance, minimum copper trace/space feature sizes, and available space for support circuitry. Manufacturing and reliability issues related to board thickness, via diameter, and hence via aspect ratio also limit printed antenna radiating elements/AESA radiating aperture subarrays and arrays. Larger printings have issues with lamination, warping, layer-to-layer registration, etc.

SUMMARY

In one aspect, embodiments of the inventive concepts disclosed herein are directed to an antenna and manufacturing process for antennas that produce radiating elements of desired size for certain frequency bands by bump mounting radiating elements to the printed circuit board substrate. Driving circuitry can be stacked to save space and enable Dual Orthogonal Linear Polarization (DOLP). Also, the radiating elements may be made using a different dielectric constant material as compared to the connecting substrate.

In a further aspect, tiling radiating elements or sub-arrays or radiating elements with bump mounting allows for spatial separation that eliminates surface waves. In another aspect, bump mounted elements with less directivity allow broader elevation beam scanning down to horizon.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1A:
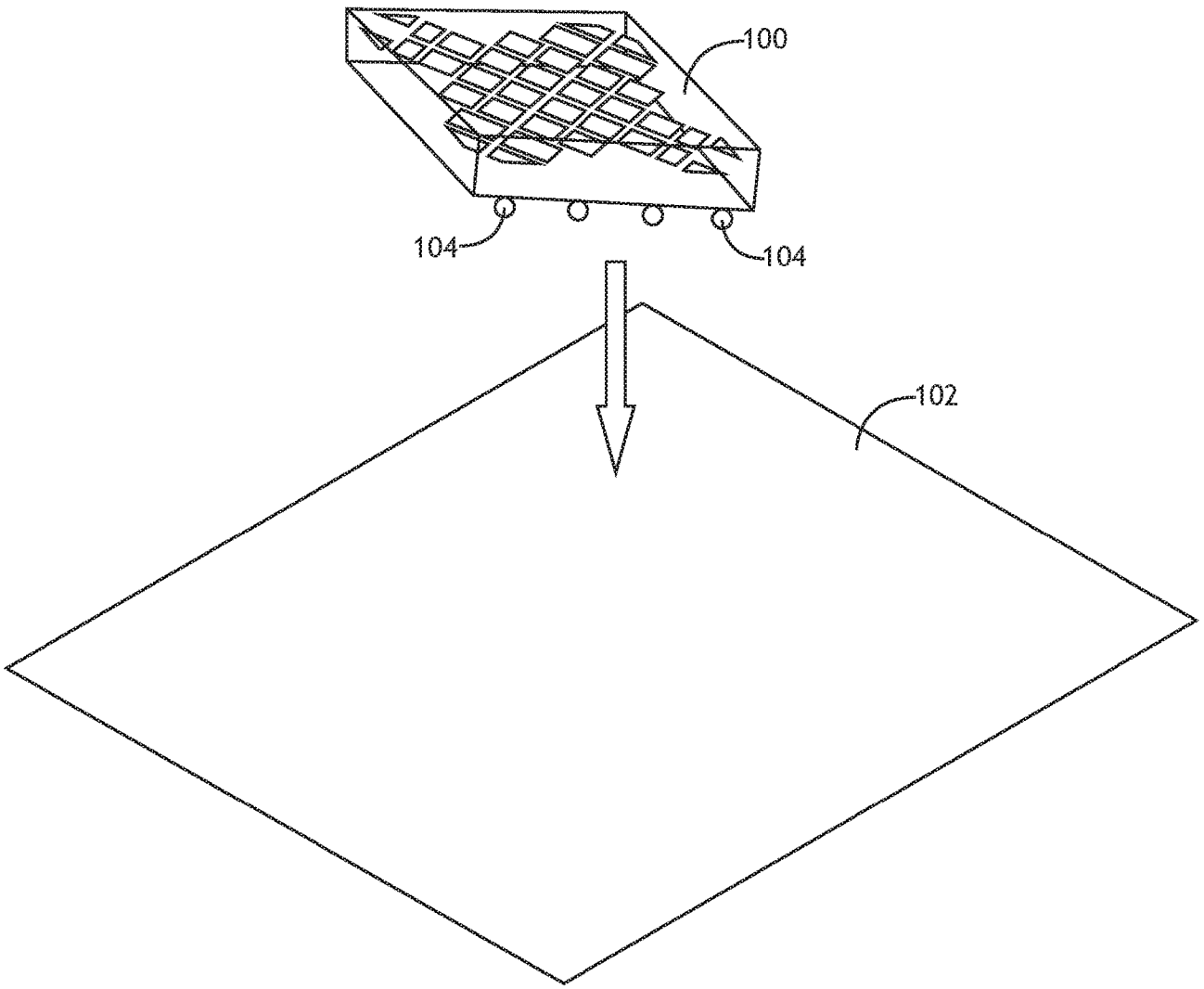
FIG. 1A shows a perspective, environmental view of a bump mounted radiating element according to an exemplary embodiment.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to an antenna and manufacturing process for antennas that produce radiating elements of desired size for certain frequency bands by bump mounting radiating elements to the printed circuit board substrate. Driving circuitry can be stacked to save space. Also, the radiating elements may be made using a different dielectric constant material as compared to the substrate. Tiling radiating elements or sub-arrays or radiating elements with bump mounting allows for spatial separation that eliminates surface waves.

Figure 1B:
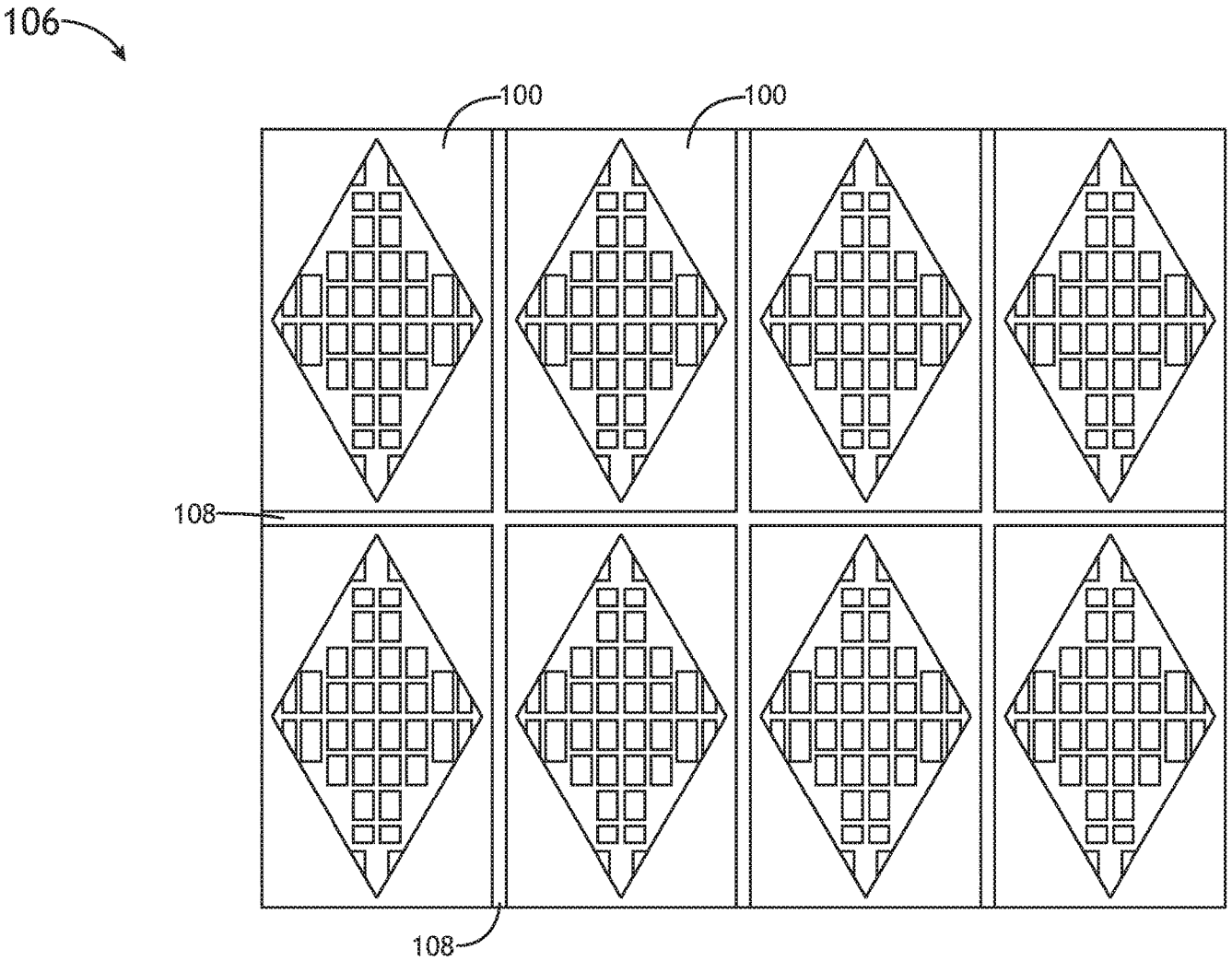
FIG. 1B shows a top view of an array of bump mounted radiating elements according to an exemplary embodiment.

Referring to FIGS. 1A and 1B, a perspective, environmental view of a bump mounted radiating element 100 and a top view of an array 106 of bump mounted (or bump attached) radiating elements 100 according to exemplary embodiments are shown; it should be appreciated that radiating elements 100 of various shapes are contemplated (for example, rectangular, triangular, irregular, etc.), and the visual representations shown herein are not intended to be limiting. Bump mounting comprises a surface mounting technique similar to ball grid array (BGA), and includes applying solder balls to contact points on the radiating element or PCB layer, and then completing the contact with the opposing PCB or radiating element; the contact points being previously defined, bump mounting tends to pull the elements to a desired position via surface tension. The radiating element 100 is fabricated according to the processes and materials necessary for a particular application; in at least one embodiment, the radiating elements 100 are configured for operation at less than six GHz. As opposed to state-of-the-art lithographic fabrication techniques where radiating elements are fabricated on the printed circuit board, radiating elements 100 according to the present disclosure may be fabricated utilizing non-traditional processes such as 3D additive manufacturing, metallic plated injection molded plastic, stamped sheet metal, etc. Furthermore, radiating elements 100 may be fabricated with material properties separate from the beamformer driving circuitry; for example, the radiating elements 100 may be made from materials with a low dielectric constant while the interconnecting printed circuit board with a continuous ground plane 102 may be fabricated with materials having a high dielectric constant.

Transmission line beam former design benefits from high dielectric constant materials because high dielectric constants allow for physically smaller components. However, antenna radiating elements benefit from low dielectric constant materials to extinguish surface waves.

The radiating element 100 is then attached to an interconnecting printed circuit board with a continuous ground plane 102 via a plurality of solder balls 104 (bump mounted). In at least one embodiment, surface tension locates the solder balls 104 at the appropriate locations on the radiating element 100 and interconnecting printed circuit board with a continuous ground plane 102 where the fabrication process for each of the radiating element 100 and interconnecting printed circuit board with a continuous ground plane define electrically conductive attach points. Such attachment points may be part of the lithographic fabrication process of the interconnecting printed circuit board with a continuous ground plane 102. Because the attachment points are defined by the lithographic fabrication process, surface tension positioning increases placement accuracy.

The interconnecting printed circuit board with a continuous ground plane 102 may be fabricated with a low degree of warp and twist relative to an interconnecting printed wiring board with integral radiating elements.

In some embodiments, when the radiating elements 100 are smaller than ½λ spacing on the interconnecting printed circuit board with a continuous ground plane 102, the antenna may have low gain, enabling broad beam scanning to the horizon.

In at least one embodiment, radiating elements 100 are organized into an array 106 on the interconnecting printed circuit board with a continuous ground plane 102 with each of the radiating elements 100 separated from neighboring radiating elements 100 by an isolation gap 108. Array lattices may be rectangular or triangular, though rectangular may be preferred for tiling. Furthermore, in at least one embodiment, radiating element arrays 106 may be fabricated as a single piece of multiple radiating elements 100; the array 106 then being bump mounted. Arrays 106 of less than ½λ spacing may be used to produce different printed apertures. Arrays 106 could be multi-chip modules, with multiple chips.

In at least one embodiment, radiating elements 100 are bump attached via solder balls 104 to a corrugated ¼λ choke interconnecting printed circuit board with a continuous ground plane 102, for example as used in GPS surveyor applications, to extinguish ground currents and enhance side scan dual orthogonal linearly polarized or circularly polarized wide scan operations.

Bump mounting allows for non-traditional assemblies of electromagnetic components to solve problems that are potentially insurmountable with existing monolithic multilayer circuit boards.

Low frequency challenges are related to absolute size. For example, as the frequency decreases from 1 GHz down to 700 MHz, the wavelength increases from 12 inches to 17.14 inches in which substrate height also increases as 0.7 times more beyond the PCB fabrication limit. Antennas operating in those frequency ranges may be prohibitively large with current technology.

In at least one embodiment, different regions of the array 106 may operate at different frequencies. For example, the center of the array 106 may operate at highest frequency with the tightest lattice density, with the lattice density decreasing outwardly as the array 106 expands to lower and lower frequency regions.

A common beam forming network may engage all of the radiating elements 100 and could be either analog or digital. The common ground plane 102 is what all of the circuitry drives against from an RF perspective.

Figure 2:
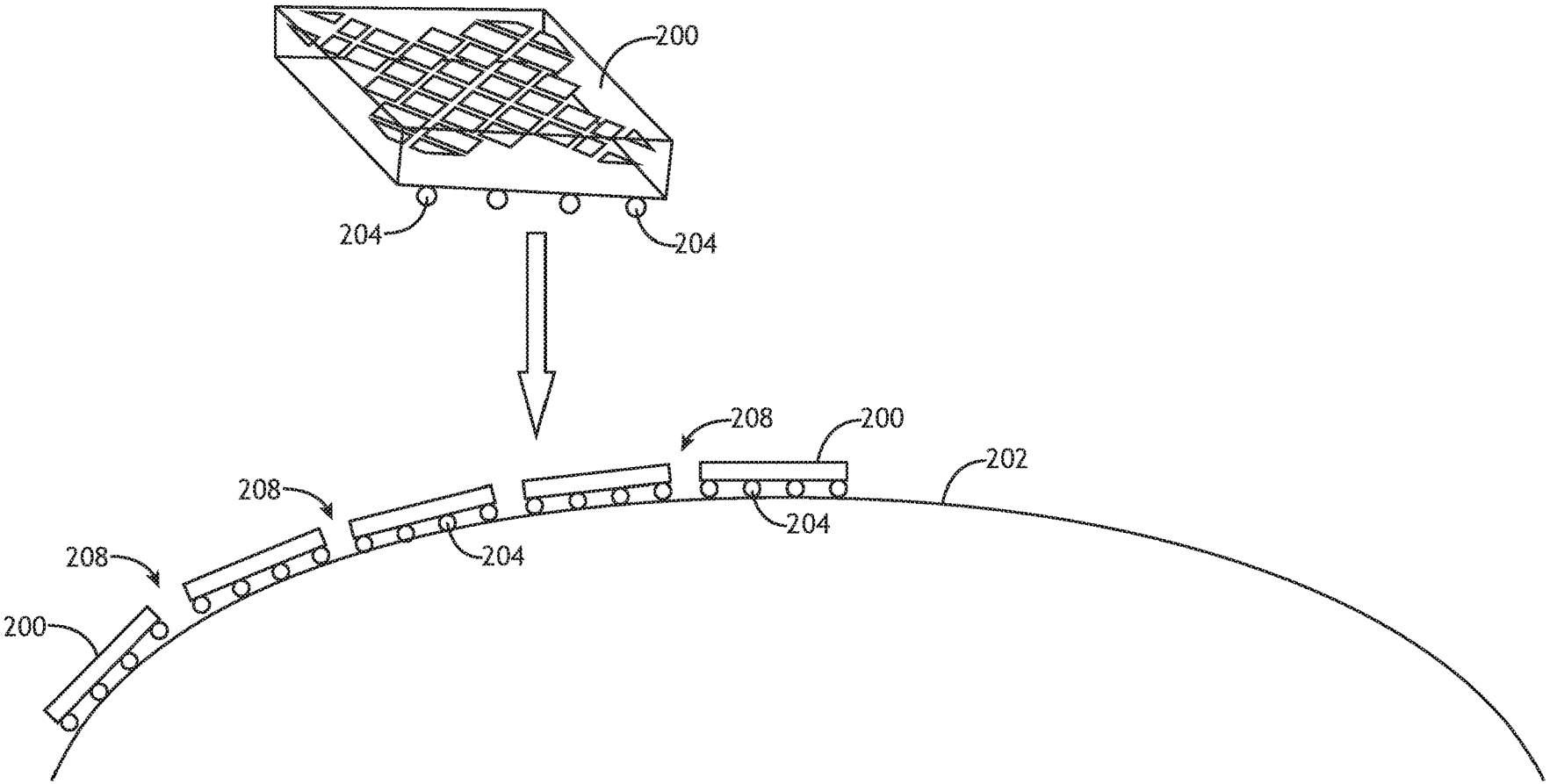
FIG. 2 shows a side, environmental view of an array of bump mounted radiating elements according to an exemplary embodiment.

Referring to FIG. 2, a side, environmental view of an array of bump mounted radiating elements 200 according to an exemplary embodiment is shown. The radiating elements 200 are bump mounted to a conformal interconnecting printed circuit board with a continuous ground plane 202 via a plurality of solder balls 204. A sloped or curved interconnecting printed circuit board with a continuous ground plane 202 enhances wide-scan performance. Furthermore, manufacturing a curved interconnecting printed circuit board with a continuous ground plane 202 and otherwise planar individual radiating elements 200 is simpler where the radiating elements 200 are bump mounted. Traditional fabrication techniques would require the interconnecting printed circuit board with a continuous ground plane 202 to be much thicker, and therefore more difficult to manufacture a conforming embodiment. In at least one embodiment, the interconnecting printed circuit board with a continuous ground plane 202 beam former may be implemented with flex circuitry, strips or slats or rigid printed circuit boards, 3D additive manufactured embedded transmissions lines, etc. In such embodiments, the non-planar radiating surface is fed by a non-planar beam former to accommodate it.

In at least one embodiment, the radiating elements 200 are separated from each other by an isolation gap 208 that breaks up the monolithic grounded dielectric slab and suppress surface waves.

Figure 3:
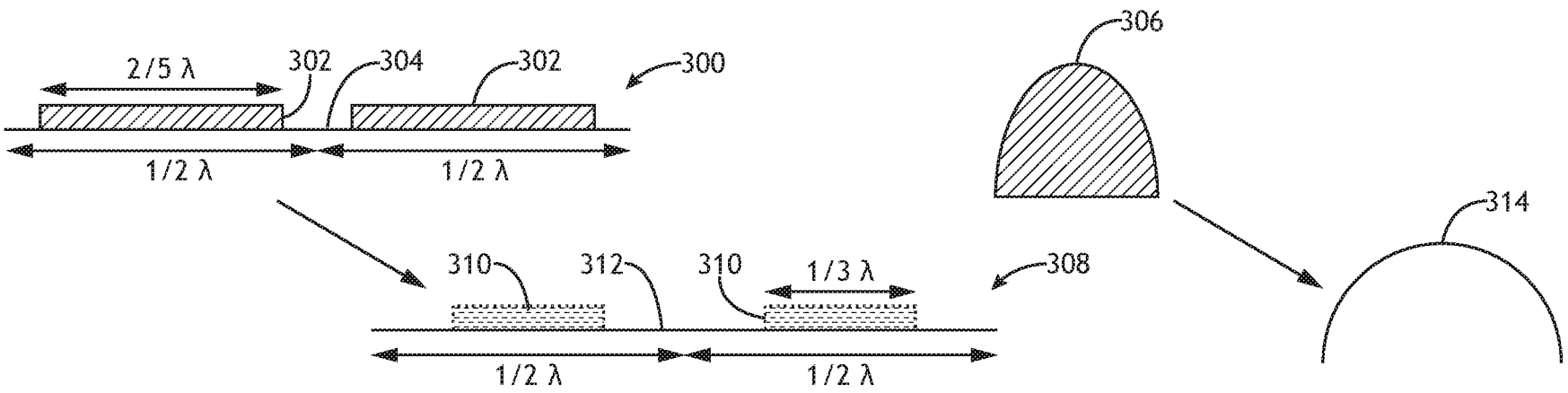
FIG. 3 shows a side, block representation of radiating elements according to an exemplary embodiment.

Referring to FIG. 3, a side, block representation of radiating elements 302, 310 according to an exemplary embodiment is shown. Antennas 300, 308 having bump mounted radiating elements 302, 310 may have tailored performance characteristics defined by the size of the isolated radiating elements 302, 310 with respect to the operating wavelength. For example, where an antenna 300 has radiating elements 302 approaching the ½λ spacing defined for each radiating element 302, the beam 306 may be a high gain, narrow width beam. Alternatively, where an antenna 308 has radiating elements 310 much smaller than the ½λ spacing defined for each radiating element 310, the beam 314 may be a low gain, broad beam. In at least one embodiment, tiling may allow radiating elements 310 that produce a low gain, broad beam 314 to operate in concert to increase the overall gain of the signal. While radiating elements 302, 310 with widths of ⅔λ and ⅓λ respectively are shown, it should be appreciated that other widths are contemplated provided they are below ½λ.

In at least one embodiment, neighboring radiating elements 302, 310 are separated by isolation gaps 304, 312 to prevent surface waves. Also, in at least one embodiment, an array may include larger radiating elements 302 in a center region to enhance gain, with smaller radiating elements 310 in the outer regions to enhance scan angle.

Figure 4:
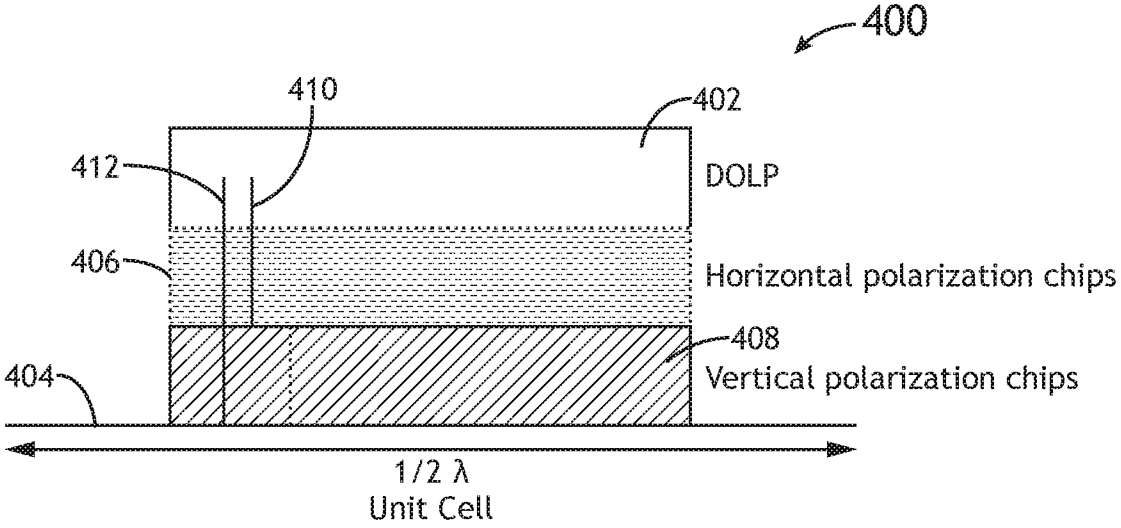
FIG. 4 shows a side, block representation of a stack of radiating elements according to an exemplary embodiment.

Referring to FIG. 4, a side, block representation of a stack 400 of radiating elements according to an exemplary embodiment is shown. In at least one embodiment, the stack 400 is configured for a dual-orthogonal linear polarization radiating element 402. The radiating element 402 is driven by horizontal polarization circuitry 406 and vertical polarization circuitry 408. The horizontal polarization circuitry 406 is connected to the radiating element 402 by a first via 410 and the vertical polarization circuitry 408 is connected to the radiating element 402 by a second via 412. The entire stack 400 is connected to an interconnecting printed circuit board with a continuous ground plane 404 utilizing the bump mounting techniques described herein. The driving circuitry may thereby be stacked to reduce the overall footprint with respect to the radiating element 402.

A stack 400 according to such embodiment may solve the dual-orthogonal linear polarization array lattice compaction problem for millimeter wave arrays. First order dual-orthogonal linear polarization packaged circuitry requires up to twice the amount of surface area to implement relative to a single, linear polarization, which lowers the conflict free operational frequency by two times. For higher than twenty GHz operation, the required board array for dual-orthogonal linear polarization is in conflict with the array lattice size density required for grating lobe-free operation. Transmit/receiver die stacking on the radiating element 402 can enable dual-orthogonal linear polarization or any other arbitrary polarization operation to reside in the same surface area as compared to single, linear polarization.

Embodiments of the present disclosure enable arbitrary polarization by combining vertical polarization circuitry 408 and horizontal polarization circuitry 406 with the appropriate amplitude and phase.

Figure 5:
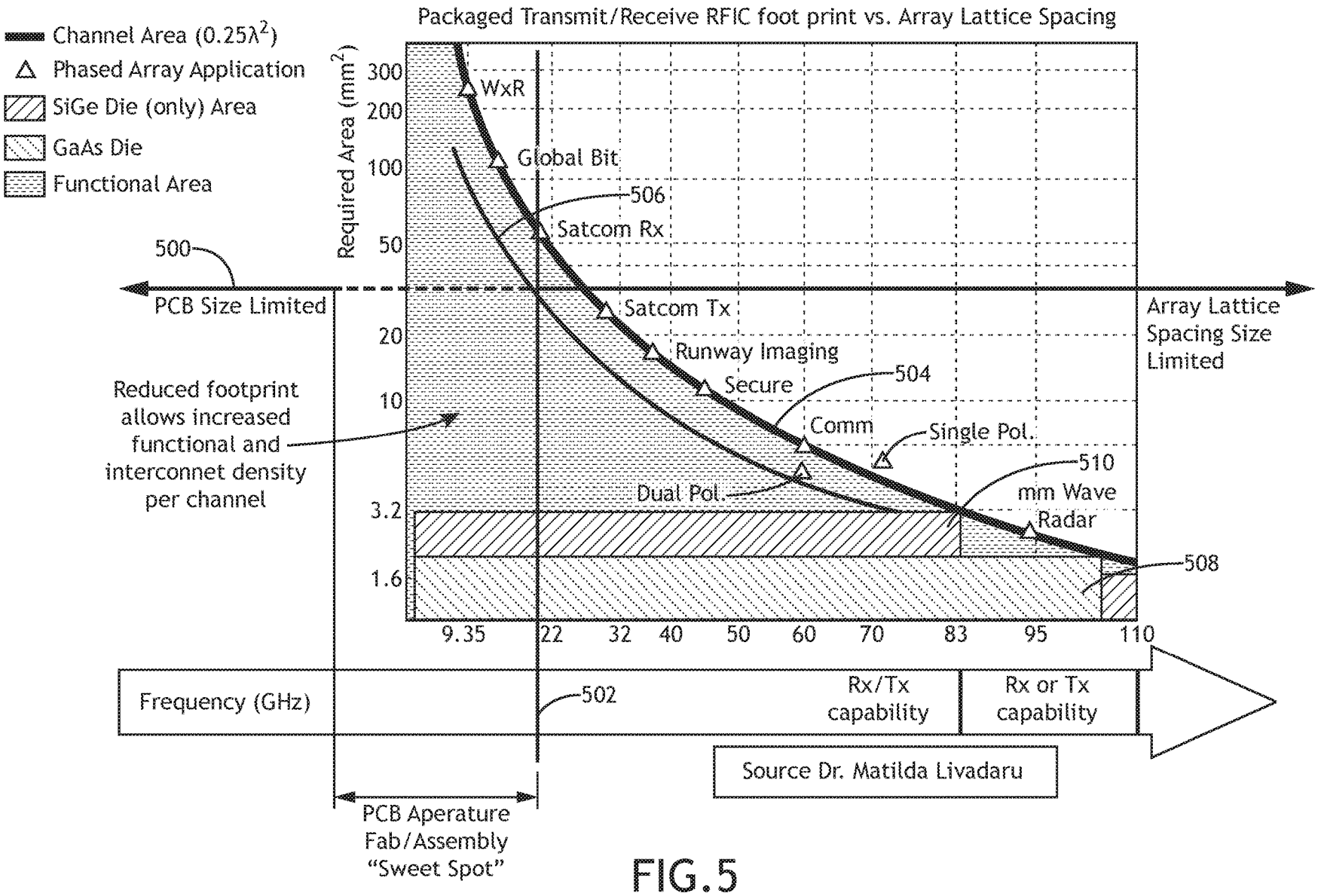
FIG. 5 shows a graph of radiating element performance metrics.

Referring to FIG. 5, a graph of radiating element performance metrics is shown. The graph shows required lattice spacing footprint in square millimeters as a function of the operating frequency. Using existing technology and methods, there are manufacturing limitations 500 defined by the printed circuit board aperture fabrication and assembly 502; between about six GHz and twenty-two GHz. Above twenty-two GHz, the physical size of the packages that hold the electronic device begin violating the ½λ by ½λ rule. Below six GHz, the printed circuit board size is outside reliable manufacturing boundaries. In some cases, the dielectric constant of the die material (for example, gallium arsenide 508 or silicon-germanium 510) is a limiting factor. Lattice spacing for single polarized radiating elements 504 and for dual-polarized radiating elements 506 are different based on the operating frequency because dual simultaneous polarization requires twice as much circuitry and a vertical channel.

Embodiments of the present disclosure allow the window of efficient manufacturing to be expanded because the limitations of the printed circuit board are not imposed on the radiating element, and the limitations of the radiating element are not imposed on the beam forming circuitry.

Embodiments of the present disclosure enable complex printed radiator element arrays that operate below the C band, and/or high frequency phased arrays that operate in bands higher than the Ka-Band while also eliminating or suppressing parasitic surface waves. Especially for dual-orthogonally polarized radiating elements, embodiments of the present disclosure reduce manufacturing complexity. Non-traditional and traditional printed circuit board fabrication methods may be combined. Broad angle, low-to-the-horizon scan performance with different element sizes allows for beam width/gain balancing.

One existing method for suppressing parasitic surface waves includes surrounding radiating elements with vias. Such method is inefficient for antennas with hundreds or thousands of radiating elements. Embodiments of the present disclosure obviate the need for such vias.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. An antenna apparatus comprising:

a plurality of radiating elements; and an interconnecting printed circuit board with a continuous ground plane, wherein:

each of the plurality of radiating elements are bump-mounted to the interconnecting printed circuit board with a continuous ground plane;

the radiating elements are disposed on the ground plane with an isolation gap between neighboring radiating elements, the isolation gap configured to suppress parasitic surface waves;

each radiating element comprises a material having a first dielectric constant;

the interconnecting printed circuit board with a continuous ground plane comprises a material having a second dielectric constant;

the first dielectric constant is lower than the second dielectric constant; and the radiating elements are disposed on the interconnecting printed circuit board with a continuous ground plane with decreasing lattice density from a center of the interconnecting printed circuit board with a continuous ground plane to an outer perimeter such that the center of the ground plane defines a region of enhanced gain and the outer perimeter defines a region of enhanced scan angle.

2. The antenna of claim 1, wherein each radiating element comprises a dual-orthogonal linear polarizing radiating element, horizontal polarization circuitry, and vertical polarization circuitry, wherein the antenna is configured to create arbitrary polarization.

3. The antenna of claim 1, the interconnecting printed circuit board with a continuous ground plane conforms to a curved surface.

4. The antenna of claim 1, wherein:

a first set of radiating elements in the plurality of radiating elements are no more than ⅖ of an operating wavelength in width and are disposed at a periphery of the interconnecting printed circuit board with a continuous ground plane; and a second set of radiating elements in the plurality of radiating elements are no less than ⅓ of the operating wavelength in width and are disposed at a center of the interconnecting printed circuit board with a continuous ground plane.

5. The antenna of claim 4, wherein the first set of radiating elements are configured for lower gain and broader beam as compared to the second set of radiating elements.

6. The antenna of claim 1, wherein the antenna is configured to operate in a frequency range less than six GHz.

7. A method of manufacturing an antenna comprising:

applying a plurality of solder balls to electrical contact points on each of a plurality of radiating elements;

organizing the plurality of radiating elements with an isolation gap between neighboring radiating elements, the isolation gap configured to suppress parasitic surface waves; and affixing each radiating element to an interconnecting printed circuit board with a continuous ground plane via the solder balls, wherein:

each radiating element comprises a material having a first dielectric constant;

the interconnecting printed circuit board with a continuous ground plane comprises a material having a second dielectric constant;

the first dielectric constant is lower than the second dielectric constant; and each radiating element comprises a dual-orthogonal linear polarizing radiating element, horizontal polarization circuitry, and vertical polarization circuitry, wherein the antenna is configured to create arbitrary polarization.

8. The method of claim 7, further comprising organizing the plurality of radiating elements with decreasing lattice density from a center of the interconnecting printed circuit board with a continuous ground plane to an outer perimeter such that the center of the ground plane defines a region of enhanced gain and the outer perimeter defines a region of enhanced scan angle.

9. The method of claim 7, further comprising conforming the interconnecting printed circuit board with a continuous ground plane to a curved surface.

10. The method of claim 7, wherein:

a first set of radiating elements in the plurality of radiating elements are no more than ⅖ of an operating wavelength in width and are disposed at a periphery of the interconnecting printed circuit board with a continuous ground plane; and a second set of radiating elements in the plurality of radiating elements are no less than ⅓ of the operating wavelength in width and are disposed at a center of the interconnecting printed circuit board with a continuous ground plane.

11. The method of claim 10, wherein the first set of radiating elements are configured for lower gain and broader beam as compared to the second set of radiating elements.

* * * * *